US005567166A

United States Patent [19]

Lemke

[11] Patent Number: 5,567,166

[45] Date of Patent: Oct. 22, 1996

[54] LOW PROFILE CONNECTOR AND PROCESSES FOR MAKING AND USING THE SAME

[75] Inventor: Timothy Lemke, Carlisle, Pa.

[73] Assignee: Berg Technology, Inc., Reno, Nev.

[21] Appl. No.: 225,242

[22] Filed: Apr. 8, 1994

[51] Int. Cl.[6] ..... H01R 9/09

[52] U.S. Cl. ..... 439/74

[58] Field of Search ..... 439/74, 66, 284, 439/289, 293, 660

[56] References Cited

U.S. PATENT DOCUMENTS

| | | | |
|---|---|---|---|
| 3,193,793 | 7/1965 | Plunkett et al. | 439/660 |
| 3,394,337 | 7/1968 | Miller | 439/680 |
| 3,868,162 | 2/1975 | Ammon | 439/75 |
| 4,045,107 | 8/1977 | Sutherland | 439/289 |
| 4,482,937 | 11/1984 | Berg | 439/65 |
| 4,496,207 | 1/1985 | Ensminger | 439/404 |
| 5,055,054 | 10/1991 | Doutrich | 439/66 |
| 5,083,696 | 1/1992 | Kan et al. | 228/44.7 |
| 5,098,311 | 3/1992 | Roath et al. | 439/289 |
| 5,161,982 | 11/1992 | Mowry | 439/68 |
| 5,234,353 | 8/1993 | Scholz et al. | 439/289 |
| 5,306,163 | 4/1994 | Asakawa | 439/607 |
| 5,378,160 | 1/1995 | Yumibe et al. | 439/66 |

OTHER PUBLICATIONS

Timothy A. Lemke, Richard A. Elco, Du Pont Electronics; "Designing for Packaging in the 90's—High Performance, Density and Pin Count"; *Connection Technology,* Aug. 1990.

*Primary Examiner*—Neil Abrams

*Attorney, Agent, or Firm*—Woodcock Washburn Kurtz Mackiewicz & Norris

[57] ABSTRACT

A low profile connector is provided by the invention. According to the invention two sets of contacts are secured in a housing capable of being mounted to a printed circuit board so that the contacts extend laterally from the housing in parallel to the printed circuit board. A first end of each contact can be coupled to an I/O lead of a printed circuit board and a second end of each contact remains unsupported. A mating low profile connector according to the invention similarly provides two sets of contacts secured in a housing capable of being mounted to a printed circuit board so that the contacts extend laterally from the housing in parallel to the printed circuit board. The contacts are compliant and are designed to extend above the mating reference of the connector. The dimensions of the contacts are selected to provide minimum pitch and optimal compliance. A process for making the low profile connector by molding a contract strip into a housing is also disclosed. Additionally, a process for using the connectors to connect printed circuit boards in a stacked arrangement is disclosed.

41 Claims, 8 Drawing Sheets

LOW PROFILE CONNECTOR AND PROCESSES FOR MAKING AND USING THE SAME

FIELD OF THE INVENTION

The present invention relates to electrical connectors, and more particularly, to low profile connectors for use in connecting circuit boards in a stacked arrangement.

BACKGROUND OF THE INVENTION

The rapid development of electronic logic devices for data processing and communications systems is placing rigorous demands on electrical connectors. Increasing integration of solid state devices, combined with the need to increase the speed of data processing and communication systems, requires that connectors have higher densities, higher pin counts, and better electrical performance than in the past.

Conventional connectors have traditionally used male and female connectors. A typical male connector provides a number of rows of pins extending from a connector housing. The housing of a typical female connector provides a number of rows of receptacles. The pattern of receptacles is intended to match the pattern of pins on the male connector. When the male and female connectors are mated, the pins are forcibly inserted into the receptacles. When the connectors are unmated, the pins are forcibly withdrawn from the receptacles. The forces applied to the pins during mating and unmating require that the pins be thick enough or rigid enough to endure these forces without damage. Traditional connectors have, therefore, been relatively large so that the pins could be designed to withstand these forces.

Density and pin count are often viewed interchangeably, but there are important differences. The density refers to the number of contacts provided per unit length. In contrast, the number of contacts or pins that can reasonably withstand the mating and unmating forces is referred to as the pin count.

As more functions become integrated on semiconductor chips or on flexible circuit substrates and more chips are provided on printed circuit boards (PCBs), each PCB or flexible circuit must provide more inputs and outputs (I/Os). In addition, many system components are capable of operation at faster speeds than previously. The connectors used in high-speed board-to-board (including both PCBs and flexible circuits) communications may be treated like transmission lines in which crosstalk and noise become significant concerns. The electrical performance of high-speed board-to-board communications is, therefore, dependent upon the amount of crosstalk and noise introduced at the PCB interfaces.

Although, the invention and background of the invention are described in terms of connecting PCBs it should be understood that the invention should not be limited thereto. Specifically, any reference to PCBs herein is intended to include other circuit substrates such as flexible circuits.

Dimensional mismatches in conventional connectors also degrade the system's electrical performance. Specifically, the size and location of the connector pins and receptacles of the mating connector may differ resulting in an unstable connection. Moreover, if the pin and receptacle pattern of a male and female connector, respectively, differ or are slightly misaligned, the electrical interface provided by the connection may be impaired.

Density, pin count, and electrical performance are related to one another. Design factors should be balanced to optimize the connector in terms of its density, pin count and electrical performance. Density can be increased by decreasing the distance between contacts and by increasing the number of rows in a connector. Increasing the density may also increase the pin count because 1) more pins are available for mating and unmating, and 2) higher density reduces the linear tolerances per pin as mating and unmating forces are averaged over more pins. An increase in contact density may, however, adversely affect the electrical performance of the connector since crosstalk can increase by bringing the pins into closer proximity to one another. The addition of rows to increase the contact density may also increase the electrical path length of signals transmitted over the board-to-board interface thereby reducing the speed of the system and increasing the potential for noise.

The pin count is limited in part by the mechanical forces applied when the connector is mated and unmated. Some connectors have been designed to reduce these forces by providing contact elements that extend from both male and female connectors or from hermaphroditic connectors. Examples of such connectors are disclosed in U.S. Pat. No. 3,868,162, issued to Ammon on Feb. 25, 1975, and U.S. Pat. No. 5,098,311, issued to Roath et al. on May 24, 1992, respectively. (Contact connectors may be referred to as blade-on-beam connectors when one contact is static and the mating contact is compliant or beam-on-beam connectors when both of the mated contacts are compliant.) However, the pin count for contact connectors is limited by tolerances imposed on the contacts from the contacts of the mating connector. A balancing of the elasticity, maximum stress, and the dimensions of the contacts is required to provide an adequate normal force between the mated contacts for a stable electrical interface. Balancing of these factors may in turn affect density and pin count.

A contact connector functions by bringing metal contacts, that are typically attached to electronic subassemblies, together with a specified amount of force or compliance. The force requirements are, to some degree, dependent on the application, environment and surface finishes. However, it is generally accepted that under the best of conditions, with precious metal platings covering the contacts, a minimum contact force of about 35 grams is required.

Modern data processing and communications components use "mezzanine" or parallel board stacking arrangements in which the planar surfaces of printed circuit board assemblies are connected parallel to one another. In miniaturized systems, it is desirable to reduce the profile or height of the connectors that interconnect the printed circuit boards. State-of-the-art connectors presently have profile heights of about 3.5–4.0 mm, with linear contact spacings of about 1 mm. To accommodate the miniaturization of modern electronics it is desirable to have connectors with profile heights as low or lower than 2 mm with contact spacings of approximately 0.5 mm.

Another factor that is significant in connector design is cost. Generally blade-on-beam connectors merely provide a plurality of contacts attached to a housing. Thus, in miniaturized connectors, material costs are relatively small as compared to labor or conversion costs. Usually the most significant cost factor in the production of a contact connector is the assembly of the contacts to the housing.

There are three basic methods of assembling contact connectors:

1. Stitching contacts into plastic housings;

2. Mass inserting contacts into plastic housings; and

3. Molding a plastic housing around a strip of contacts.

Each of these methods has many advantages and disadvantages, and the costs associated with each method can vary considerably depending on the connector design, program economics, product variations, etc.

According to the first method, contacts are individually stitched or pressed into a plastic housing. The housing is provided with preformed holes through which the contacts are inserted. This method requires individual handling of each contact causing the process to be time-consuming and relatively expensive. Moreover, individual insertion of contacts through the preformed insertion holes increases the risk that the contacts may not be securely embedded in the housing.

The second and third methods have a better potential for ultimately low costs, since they eliminate the separate handling of the individual contacts during the connector assembly process. These methods traditionally require that the contacts be stamped on their finished centers. This means that the center-to-center distance (referred to as "pitch") between contacts on the original stamped strip is the same as that required in the finished connector. In particular, a plurality of contacts attached by a detachable carrier strip is stamped out of a strip of conductive material forming a contact strip. The detachable carrier strip can be used to hold a plurality of contacts simultaneously.

In "mass insertion" systems, contacts are either latched or staked into the insertion holes of a plastic housing. The carrier detachable strip may then be removed from the contacts. Because of potential dimensional variations between the contacts and their respective spacing and the insertion holes, the contacts may not be securely embedded in the housing.

According to the third method, the strip of contacts are first placed in a mold. The mold is then injected with a plastic material which sets to securely embed a portion of the contacts in the housing. After the plastic has set, the housing can be removed from the mold and the detachable carrier strip detached from the contacts. Insert molding eliminates the need to handle individual contacts during the insertion process, thereby further reducing the processing cost. Both the connector pin count and the connector density may be limited by using insert molding since conventional insert molding processes produce connectors with only a single row of contacts.

The requirement of having contacts stamped on centers limits the potential width and thickness of the contact. Stamping guidelines indicate that it is not desirable to blank a strip of metal to produce contacts having their widths less than their thickness. If these guidelines are not followed, the contacts may be twisted or subjected to too much stress. Additionally, stamping punches designed to blank metal strips to provide narrower contacts than the thickness of the metal strip are fragile and difficult to maintain. Moreover, reducing the width and thickness of the contacts may reduce the electrical performance of the connectors since the compliance of the contacts can be expected to decrease as the width and thickness are reduced.

Single beam contacts normally require that they be firmly anchored in the connector, since the stresses that are generated as a result of the contact deflection usually are highest at the base of the contact in the area where the contact is attached to the connector housing. This is another reason that molding the housing around the contacts is desirable in miniaturized connectors—there is reasonable certainty that the contact base is securely supported by the connector housing.

Traditionally, the connector contacts for connecting printed circuit boards in a stacked arrangement have been designed to extend from the housing in a direction orthogonal to the planar surface of a printed circuit board. It has, therefore, been impractical or impossible to use traditional stamped on-center contact strips and insert molding, with existing materials and processes, to design a connector with contacts having both the requisite compliance to provide a stable electrical interface, and achieve the desired low connector profile height. For example, U.S. Pat. No. 3,193,793, issued to Plunkett et al. on Jul. 6, 1965 discloses a connector design in which a maximum contact area is provided to optimize the stability of the electrical interface while minimizing the connector height profile. However, the connector disclosed by Plunkett et al. provides these advantages by forfeiting high density, high pin count and the benefits associated with insert molding.

U.S. Pat. No. 5,083,696 issued to Kan et al. discloses pin holding devices for use in connecting printed circuit boards in a stacked arrangement. However, the pins are used to permanently connect boards in a stacked arrangement such that the connection of boards is not interchangeable without at least some damage to the pins.

Therefore, there is a need to provide a stable low profile connector having a substantially maximum pin count, density, and substantially optimal electrical performance that can be produced by a low-cost process, such as insert molding.

SUMMARY OF THE INVENTION

This need is fulfilled by the present invention in which a low profile connector for use in electrically connecting circuit boards together is provided. According to the invention, a first set of electrical contacts and a housing are provided. Each electrical contact has a first end capable of being electrically interfaced with an electrical lead of a circuit board. The housing secures the first set of electrical contacts and has a mounting means for use in attaching the housing to the circuit board, so that the first set of contacts extend from the housing substantially parallel to the circuit board and with at least a portion of the contacts being with the second ends of the first set of electrical contacts being unsupported. The connector preferably provides a second set of electrical contacts that are also secured by the housing so that the second ends of the second set of electrical contacts remain unsupported and the second ends of the first set of contacts extend from the housing towards the second ends of the second set of contacts.

In a preferred embodiment, the electrical contacts are angled to extend beyond a mating reference of the connector. In an alternative preferred embodiment the electrical contacts extend from the housing to form a U-shape. In a more preferred embodiment, the electrical contacts provide a substantially optimal compliance based on maximizing the following relationship:

$$P_{min} \times 4L^3/Ebh^3 - S_{max} \times 2L^2/Ebh$$

in which:

$P_{min}$ is the minimum normal force of the electrical contacts required to provide an electrical interface;

L is the length of the electrical contacts;

b is the width of the electrical contacts;

h is the thickness of the electrical contacts;

E is the elasticity of the electrical contacts; and $S_{max}$ is the maximum stress of the electrical contacts. The electrical contacts preferably have a compliance within a range of about 0.1 mm. to about 0.2 mm.

According to the invention, a mating housing and a mating set of electrical contacts are also provided. Each electrical contact of the mating set has a first end capable of being mated to an electrical lead on another circuit board. The mating housing secures the mating set of electrical contacts and has a mounting means for use in attaching the mating housing to the other circuit board so that the mating set of contacts extend from the mating housing with at least a portion of the contacts being substantially parallel to the other printed circuit board and with the second ends of the mating set of electrical contacts being unsupported. The mating housing and the housing are capable of mating to one another so that the electrical contacts of the first set are electrically interfaced with the electrical contacts of the mating set.

In a preferred embodiment, the housing and the mating housing are capable of interlocking with each other. In another preferred embodiment, the housing and the mating housing provide an indication of the polarity of the connector.

The combined height of the housing and the mating housing once mated with one another is preferably less than approximately 3.5 mm. The distance between the centers of the electrical contacts, in preferred embodiments, does not exceed approximately 0.5 mm.

The electrical contacts of the first set and the electrical contacts of the mating set of contacts are both preferably angled to extend beyond a mating reference of the respective connectors to provide a substantially optimal compliance between the mated contacts. In this preferred embodiment, the housing comprises a latching mechanism and the mating housing comprises a mating latching mechanism such that the latching mechanism and the mating latching mechanism are operable to latch the mating housing to the housing.

A process for making a low profile connector according to the present invention is also provided. According to the invention, a first strip of conductive material is stamped to form a first set of electrical contacts having a predetermined shape. The first ends of the first set of electrical contacts are preferably connected together by a detachable strip. The first set of electrical contacts are molded into a housing to form a low profile connector substrate. The first set of electrical contacts extend from the lateral face of the housing and each electrical contact preferably bends at an angle so that at least a portion of each electrical contact extends beyond a mating reference of the housing.

After the molding step has been completed, the detachable strip may be detached from the first set of electrical contacts to form a low profile connector. The low profile connector may then be connected to a printed circuit board so that the electrical contacts of the first set extend parallel to the printed circuit board with the second ends of the first set of electrical contacts being unsupported.

In a preferred embodiment, the housing provides a first and second connecting portion and first and second end portions such that the connecting portions and the end portions form a rectangle, with the connecting portions serving as the lengths of the rectangle and the end portions serving as the widths of the rectangle. In this preferred embodiment, a second strip of conductive material is stamped to form a second set of electrical contacts having a second predetermined shape, with the first ends of the second set of electrical contacts being connected together by a second detachable strip. The second set of electrical contacts may then be molded into the housing so that the electrical contacts of the second set extend from the one lateral face of the housing towards the electrical contacts of the first set. In a more preferred embodiment, the first and second predetermined shapes are substantially the same.

In another preferred embodiment, the electrical contacts are stamped on their respective centers. The thickness of each contact is preferably about equal to the width of the contact, which in turn is substantially equally to about half the distance between consecutive centers of the electrical contacts. In a more preferred embodiment, the centers of consecutive electrical contacts are separated by approximately 0.5 mm or less.

A process of using low profile connectors according to the invention to connect circuit boards together is additionally provided. According to this process, a first low profile connector is connected to one circuit board so that the electrical contacts of the low profile connector extend laterally from its housing parallel to the circuit board. A mating low profile connector is connected to a second circuit board so that the electrical contacts of the mating low profile connector extend laterally from its housing parallel to the second circuit board. The first low profile connector is then connected to the mating low profile connector in a stacked arrangement so that the electrical contacts of respective connectors oppose one another to provide an electrical interface between the circuit boards. The electrical contacts of both respective connectors are preferably compliant at the electrical interface.

An electrical connector according to the invention comprises a housing having a mounting surface adapted to face a substrate on which the housing is to be mounted and a first contact mounting surface disposed in an angular relationship with respect to the mounting surface; and a plurality of movable contacts extending from the first contact mounting surface such that the contacts are mounted for movement toward and away from the substrate in a plane intersecting the substrate and a longitudinal axis of the housing. The contacts are preferably cantilevered from the contact mounting surface. In a preferred embodiment, the contact mounting surface is orthogonal to the mounting surface.

A connector assembly for joining a first and a second adjacent circuit substrates in a substantially parallel relationship is also provided according to the invention. In a preferred embodiment, the connector assembly comprises a first connector, comprising an insulative housing, a plurality of electrical contacts carried by the housing, and at least one member for securing the first connector on a first substrate; and a second connector intermatable with the first connector and comprising an insulation housing and a plurality of electrical contacts carried by the housing. When the first housing is mated with the second housing, the distance between the mounting surface of the first housing and the mounting surface of the second housing is preferably less than about 3.5 mm. In a more preferable embodiment, the plurality of contacts carried by the first housing are movable toward the mounting surface of the first connector and the plurality contacts carried by the second housing are movable toward the mounting surface of the second connector.

BRIEF DESCRIPTION OF THE DRAWINGS

The present invention will be better understood and its numerous objects and advantages will become apparent by reference to the following detailed description of the invention when taken in conjunction with the following drawings, in which.

DETAILED DESCRIPTION OF THE INVENTION

Figure 1:
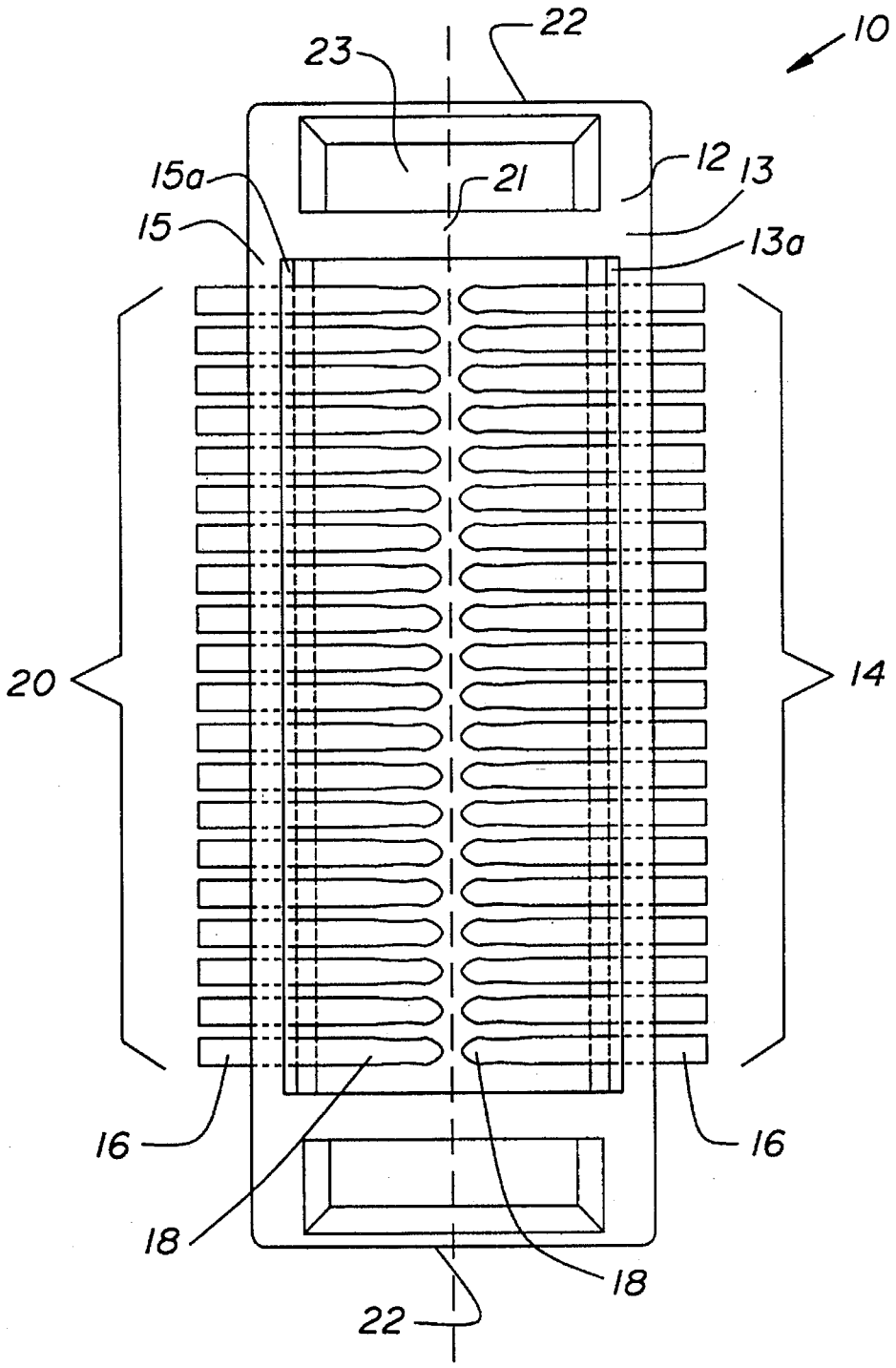
FIG. 1 shows a top view of a low profile connector according to a preferred embodiment of the invention.

A top view of a low profile connector 10 is shown in FIG. 1. A first set of electrical contacts 14 are secured by a housing 12. Each contact has a first end 16 and a second end 18. The contacts extend from a lateral face or contact mounting surface 13*a* of housing 12 with the second ends 18 being unsupported. The first ends 16 of the contacts can be interfaced with input/output leads of a printed circuit board (PCB). In a preferred embodiment, the first ends 16 of the contacts are also used to mount the connector 10 on its mounting surface 21 to a surface of the circuit board (not shown) so that the first set of contacts 14 extend from the housing 12 with at least a portion of the contacts being parallel to the circuit board. It should be understood that various types of mounting means can be carried by the housing to mount the connector to the PCB particularly prior to soldering the first ends 16 to the PCB. Alternatively, the first ends 16 can be arranged for through hole mounting in the PCB. Therefore, the use of only the first ends 16 of the contacts for mounting the connector to the PCB is merely illustrative and is not intended to be limiting.

The first set of contacts 14 preferably extend from a contact mounting surface 13*a* of the housing 12 at an angle between the range of about 1 degree and about 60 degrees with respect to the plane of the mounting surface 21 of the connector 10. In preferred embodiments, the contact mounting surface 13*a* is substantially orthogonal to the mounting surface 21.

In a more preferred embodiment, an additional or second set of electrical contacts 20 are provided as shown in FIG. 1. In this preferred embodiment, the housing 12 has a rectangular shape such that the two sides 13 and 15, corresponding to the length of the rectangle with reference to its longitudinal axis represented by the dashed line in FIG. 1, serve as connecting portions of the housing. Each of the contacts of the second set also comprises a first end 16 for interfacing with a PCB and a second end 18 for forming an electrical interface with a mating contact. The connector density can be doubled without increasing the overall length of the connector by incorporating the second set of contacts 20 into the housing 12. The housing 12 also preferably provides a self-latching mechanism for latching the connector to a mating connector. As is described below the mating contacts according to the invention exert opposing forces and, therefore, need to be held together. A latching mechanism 22 is preferably molded onto the housing 12 as shown in FIG. 1. The mating connector, in this preferred embodiment, provides a mating latching mechanism that forms a self-latching mechanism with the latching mechanisms 22. The details of the latching mechanisms are described below.

Figure 2:
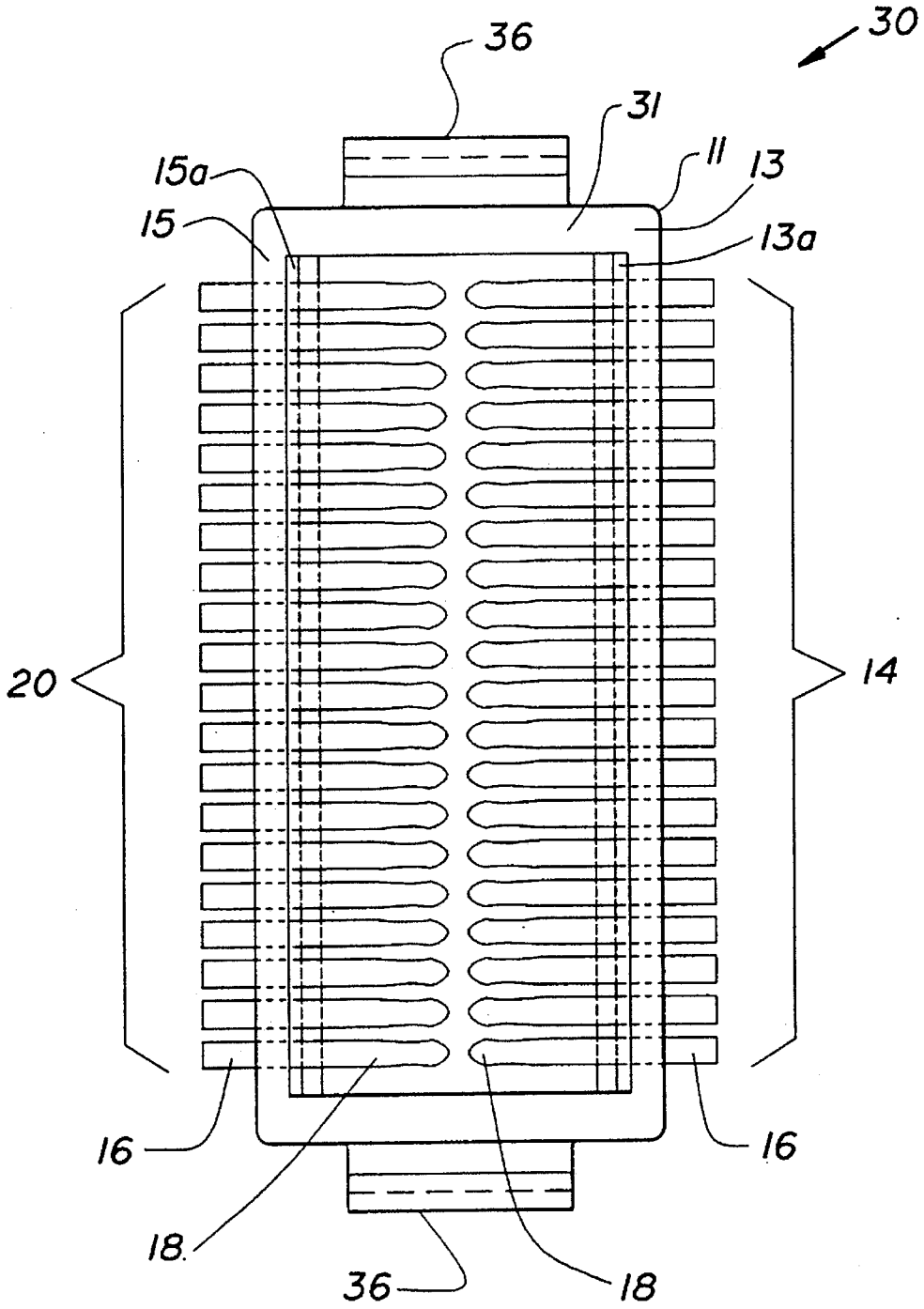
FIG. 2 shows a top view of a mating low profile connector according to a preferred embodiment of the invention.

FIG. 2 shows a top view of a mating low profile connector 30 according to a preferred embodiment of the invention. In this preferred embodiment, the mating connector 30 is substantially similar to the connector 10 shown in FIG. 1 (first set and second set, 14 and 20, of contacts having first ends 16 and second ends 18), except for the mating latching mechanism 36 as is explained below. The mating housing 11 shown in FIG. 2 is also substantially similar to the housing 12 shown in FIG. 1, with the exception of some differences that may be provided in a preferred embodiment as is also explained below.

Figure 3A:
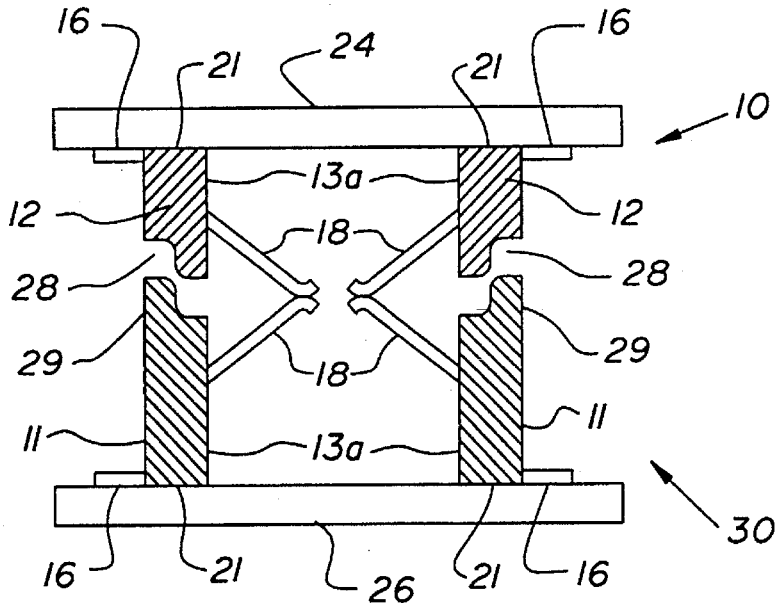
FIG. 3A shows a cross sectional side view of a preferred embodiment of a low profile connector and a mating low profile connector in an unmated position.

FIG. 3A shows a cross sectional side view of the low profile connector 10 and the mating low profile connector 30 in an unmated position. A PCB 24 is preferably electrically and mechanically connected to connector 10 via the first ends 16 of the contacts. A PCB 26 is preferably electrically and mechanically connected to the mating connector 30 via the first ends 16 of the mating contacts. The housing 12 of the connector 10 and mating housing 11 of the mating connector 30 preferably provide interlocking portions, such as the stepped surfaces 28 and 29, respectively, shown in FIG. 3A.

Figure 3B:
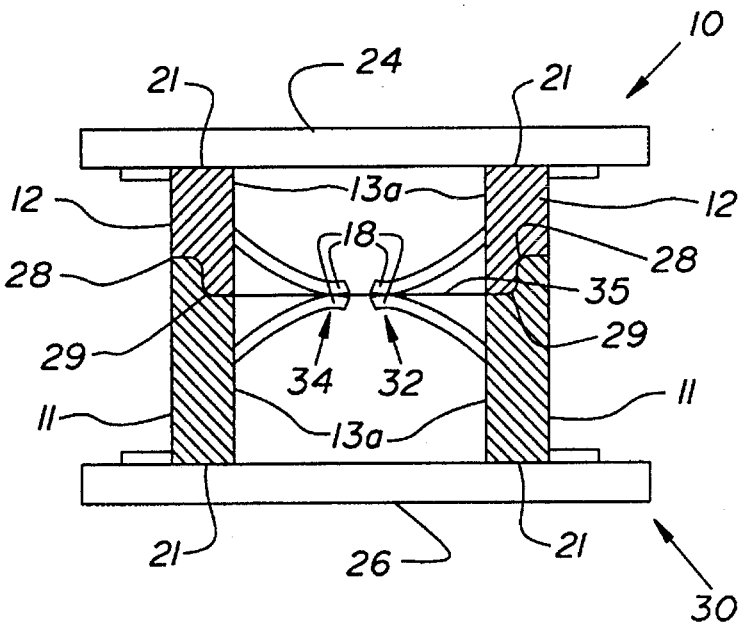
FIG. 3B shows a cross sectional side view of a preferred embodiment of a low profile connector and a mating low profile connector in a mated position.

FIG. 3B shows a cross sectional side view of connector 10 and mating connector 30 in a mated position. As shown in the figure, the stepped surfaces 28 and 29 of respective housings fit to lock the two housings together. Locking the housings together promotes a stable electrical interface between the contacts, since it reduces the possibility that the connectors may be misaligned during connection or slip after being connected.

As shown in FIG. 3B, the second end 18 of each contact of the connector 10 is pressed against a corresponding second end 18 of the mating connector 30 when the connectors are mated together. In order to provide an adequate electrical interface between the contacts, a minimum normal force between the interfacing contacts of approximately 35 grams is typically required. Thus the opposing contacts should have enough compliance at the interfaces 32 and 34 to provide the requisite normal force. The contacts of the connectors are preferably movable in a direction toward and away from the PCB in a plane intersecting both the PCB and a longitudinal axis of the side of the connector in which the contacts are secured to provide sufficient compliance.

Figure 4:
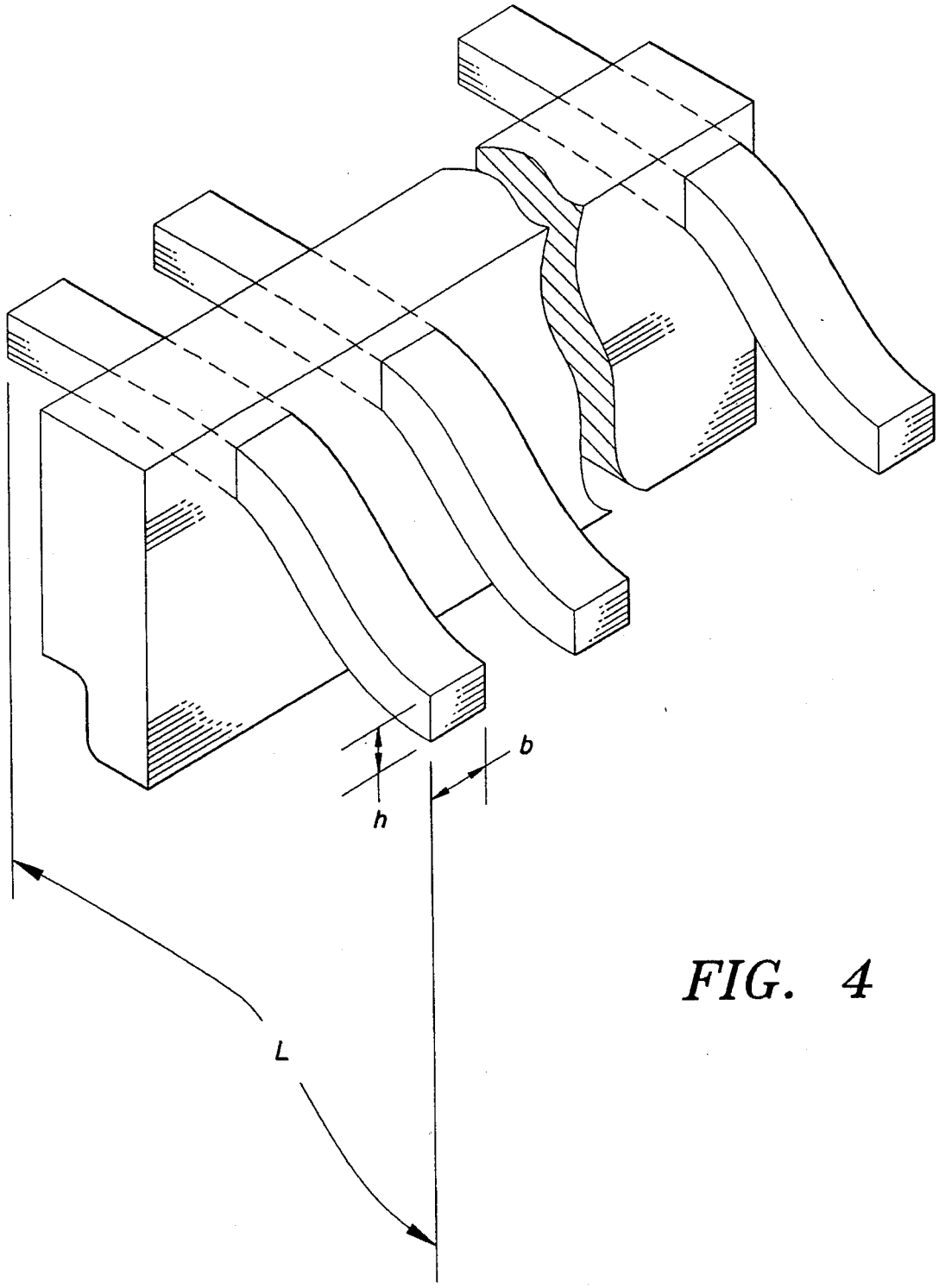
FIG. 4 shows a three-dimensional view of the electrical contacts in a preferred embodiment of the invention.

A three-dimensional view of the electrical contacts in a preferred embodiment is shown in FIG. 4 in which the length of the contacts (L), the width of the contacts (b) and the thickness of the contacts (h) are defined. In a preferred embodiment, the contacts of the connector and mating connector both provide compliant contacts so that the effects of dimensional mismatch of the contacts can be minimized. More particularly, beam-on-beam connectors have a mating reference at which the contacts theoretically interface when the connectors are mated. For example, connector 10 and mating connector 30 have a mating reference 35 as shown in FIG. 3B. Therefore, in this preferred embodiment, the tolerance or compliance ($y_{tol}$) of the contacts is determined from the following equation:

$$y_{tol}=y_L-y_{min} \quad (1)$$

where $Y_{min}$ is the minimum deflection of the contact capable of providing the requisite normal force for sustaining an electrical interface and $y_L$ is the maximum deflection of the contact. The minimum deflection, $y_{min}$ is determined according to the following relationship:

$$y_{min}=P_{min}\times 4L^3Ebh^3 \quad (2)$$

where:

$P_{min}$ is the minimum normal force of the electrical contacts required to provide an electrical interface (35 grams);

L is the length of the electrical contacts;

b is the width of the electrical contacts;

h is the thickness of the electrical contacts; and

E is the elasticity of the electrical contacts.

For example, the dimensions of the contacts depicted in FIGS. 1, 2, 3A and 3B are defined as indicated in FIG. 4. The maximum deflection of the contact, $y_L$, is determined as follows:

$$y_L=S_{max}\times 2L^2/3Eh \quad (3)$$

in which $S_{max}$ is the maximum stress of the electrical contacts i.e., the yield stress. The elasticity and stress of a particular material can be identified from a number of publicly available sources, such as tables published in most metal handbooks.

It, therefore, follows that a substantially maximum compliance for connectors according to the invention can be achieved by maximizing $Y_{tol}$. The length (L), the width (h), and the thickness (b) of the contacts are preferably defined within practical limitations to optimize the compliance between interfacing contacts of mating connectors. Specifically, a substantially optimal compliance can be achieved by maximizing $y_{tol}$ which is equal to:

$$P_{min}\times 4L^3/Ebh^3-S_{max}\times 2L^2/3Eh \quad (4)$$

by substituting equations (2) and (3) into equation (1). It should be understood that the dimensions of the contacts do not need to be selected based on the maximization of relationship (4), although it is preferable to do so.

Since the contacts of the mating connectors according to the invention oppose one another rather than hold the connectors together as in conventional connectors, a self-latching mechanism is preferably provided. As mentioned above, a latching mechanism 22 is preferably molded onto the housing 12 of the connector 10 shown in FIG. 1 and a mating latching mechanism 36 is preferably molded onto the ends of the housing 11 of the mating connector 30 shown in FIG. 2. The latching mechanism 22 of this preferred embodiment has an aperture 23 formed therein and the mating latching mechanism 36 provides flexible integrally molded barbed beams shown in FIG. 5) that are inserted through aperture 23 as the connectors are mated.

Figure 5:
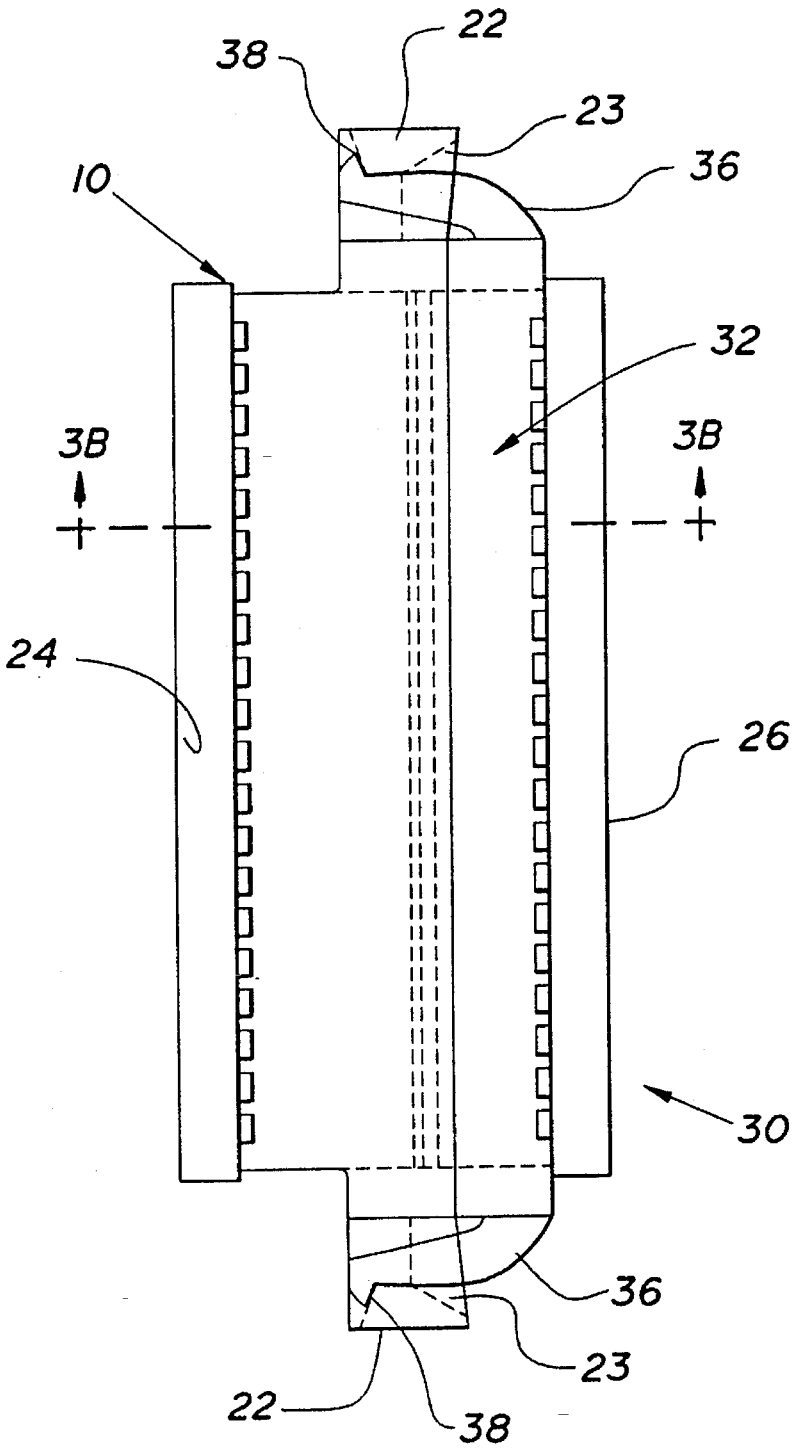
FIG. 5 shows a longitudinal cross section of a preferred embodiment of a low profile connector and a mating low profile mating connector in a mated position.

FIG. 5 shows a longitudinal cross section of the connectors in a mated position. The barbed beam 36 which forms the mating latching mechanism is shown positioned within the aperture 23. The barbed portion 38 of the barbed beam 36 catches the edge 39 of aperture 23 to secure the connectors together. The mating angle between the edge of the aperture and the barb on the beam is such that there is sufficient retention to hold the connector together, despite the opposing force of the contacts, but the retention is not high enough to prevent the unmating of the connector when desired. The housings including the barbed beam are preferably made of thermoplastic such as liquid crystal polymer. However, it should be understood that other known materials are suitable. It should also be understood that any mechanism capable of holding the connectors 10 and 30 together can be used. For instance, the connectors could be bolted or screwed together. The self-latching mechanism of the present invention does not require additional hardware and is, therefore, more economical and simpler to use.

Figure 6:
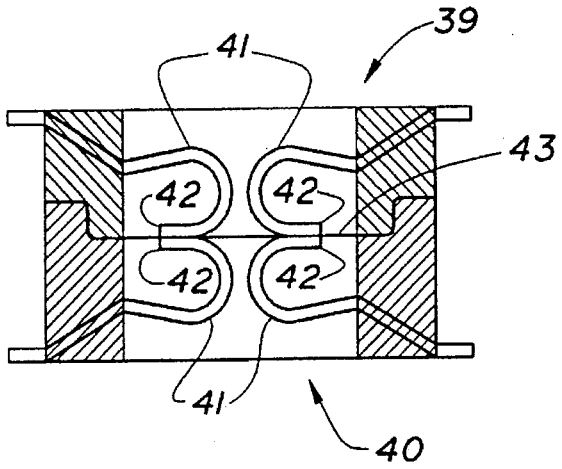
FIG. 6 shows a cross sectional side view of an alternative embodiment of the invention.

An alternative embodiment of the invention is shown in FIG. 6, in which two low profile connectors 39 and 40 are shown in a mated position. The contacts 41 of these connectors have a U-shape and unsupported ends 42 opposing each other to form an electrical interface therebetween at the mating reference 43. Connectors with U-shaped contacts may have a longer contact length which may permit more compliance between mating contacts than the angled contacts shown in FIGS. 3A and 3B. While the U-shaped contacts may achieve a higher electrical performance than the angled contacts, the U-shaped contacts may also be more complex to produce. It should be understood that numerous contact shapes are possible for providing a sufficient electrical interface according to the invention, but that the selected contact shape is preferably designed to maximize the difference between $y_L$ and $y_{min}$ as explained above, while balancing the cost of production. It should also be understood that although contact shapes may vary greatly according to the invention, the contacts should preferably extend from the housing at angle between about 1 degree and about 60 degrees and have at least one portion parallel to the surface of the PCB to provide a substantially optimal surface for interfacing with contacts of a mating connector (i.e., second ends 18 in FIGS. 3A and 3B and second ends 42 in FIG. 6 form the parallel portions).

Figure 7:
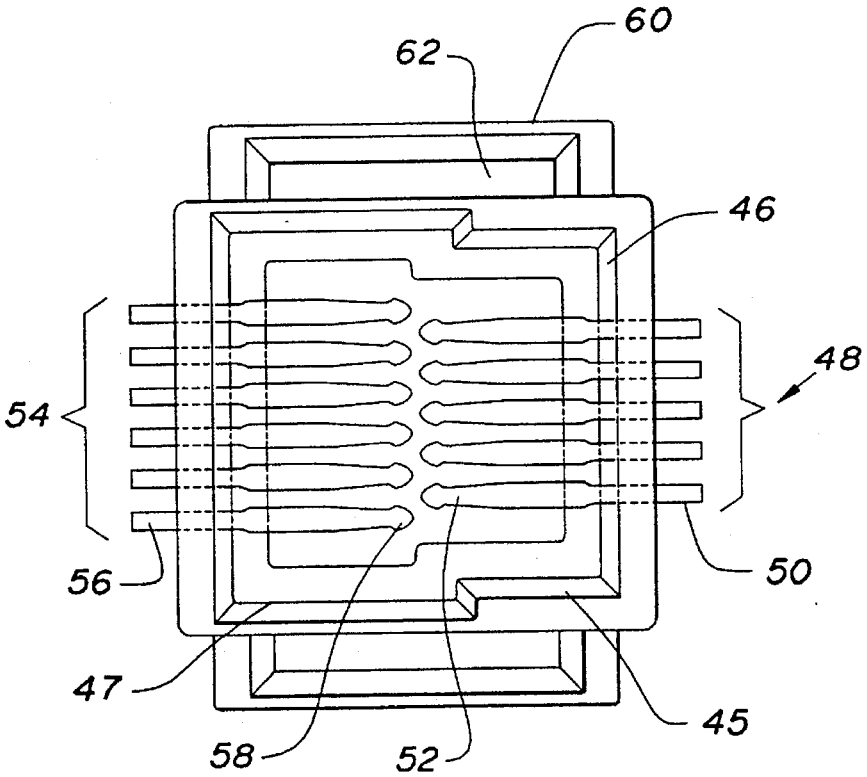
FIG. 7 shows an alternative embodiment of the low profile connector according to the invention.
Figure 8:
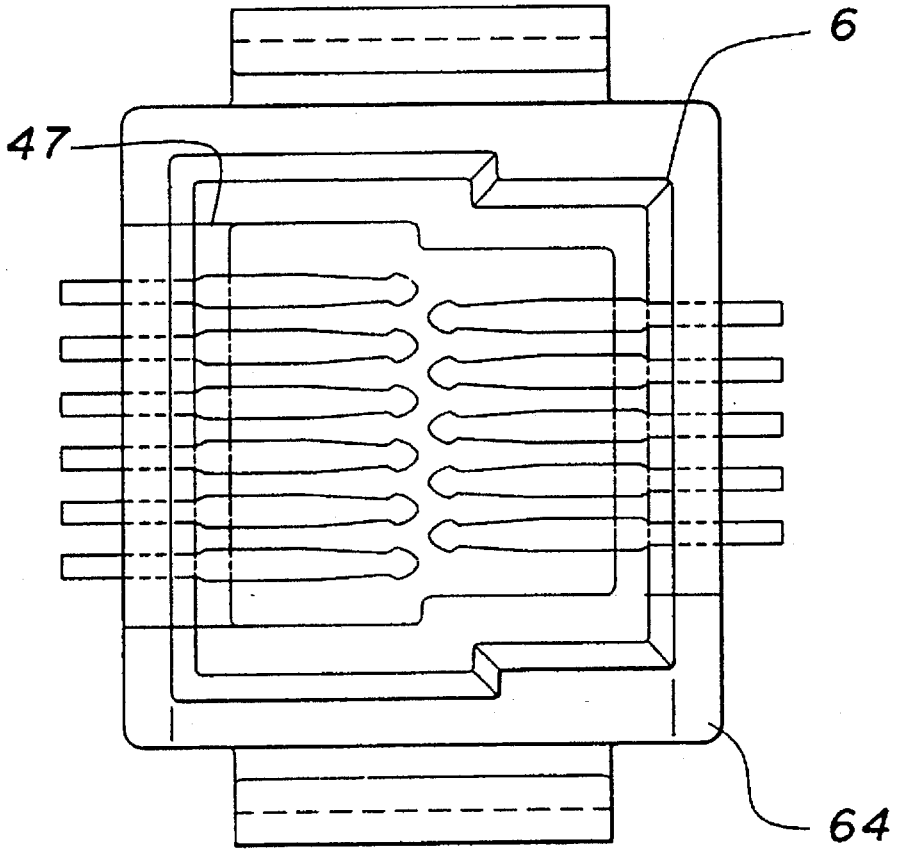
FIG. 8 shows an alternative embodiment of the mating low profile connector according to the invention.

FIG. 7 and FIG. 8 show alternative embodiments of the low profile connector and the mating low profile connector, respectively, according to the invention. As shown in FIG. 7 the housing.46 secures a first set of contacts 48 and a second set of contacts 54. The first set of contacts 48 shown in FIG. 7 has a fewer number of contacts than the second set of contacts 54. Thus, the housing 46 has a nonsymmetrical shape in that side 45 of the housing is shorter than side 47. It should be understood that a nonsymmetrically shaped housing such as the one shown in FIGS. 7 and 8 can be used to indicate the polarity of the contacts secured by the housing and prevent the possibility of mating the connector incorrectly. For example, the mating connector shown in FIG. 8, has a housing 64 with a substantially identical shape as the housing 46 (FIG. 7) so that the housings fit together in only one way.

Moreover, the first set of contacts 48 may have their centers 50 staggered with respect to the centers 58 of the contacts of the second set 54 as shown in FIGS. 7 and 8. Staggering the sets of contacts in this way may also be used as a visual indication for identifying the polarity of the contacts supported by the housing. It should be understood that numerous housing shapes can be used to provide an indication of the polarity of the contacts supported by the housing. Various arrangements of the contacts can also provide a visual indication identifying the polarity of the connector. It should further be understood that a particular contact arrangement or housing shape may be used in combination or alone to identify the polarity of the connector.

The low profile connector according to the invention is preferably made by an insert molding process. According to a preferred process of the invention, a strip of conductive material, such as beryllium copper, is run through a progressive die in which the strip is stamped to form a contact strip. In a preferred mode, the contact strip can then be electroplated with a precious metal (e.g., gold, palladium-nickel). The contacts may then be formed according to a predetermined shape (e.g., the angled shape shown in FIGS. 3A and 3B or the U-shape shown in FIG. 6).

In a preferred embodiment, the contacts are blanked on the same pitch or centerlines as the final product configuration, so that the entire contact strip can be molded without removing the individual contacts from the original stamped strip and without further altering the shape of the contacts or the contact strip. In this way, the precise dimensional relationship between the contacts and housings originally established by the stamping is maintained. Stamping the contacts on their centerlines also results in a low cost manufacturing process, since it minimizes handling of individual components.

In a more preferred embodiment, the width of the contacts stamped out are substantially equal to the thickness of the strip from which they are stamped. More preferably, the thickness of the strip is selected to be approximately half of the desired pitch of the contacts, to accommodate conventional stamping punches. By stamping the contacts pursuant to these considerations, a substantially minimum pitch can be achieved without causing the contacts to become so fragile that they twist or break. By decreasing the pitch, connectors may achieve higher densities and pin counts, while at the same time reducing their overall length. However, it should be understood that the thickness and width of the contacts must be sufficient to provide the requisite compliance for an adequate electrical interface as described above. Preferably, the contact width (b), thickness (h), and length (L) are derived by minimizing the pitch according to the stamping relationship:

$$b=h=\text{pitch}/2$$

and maximizing the contact compliance according to relationship (4) above. Using the above stamping relationship, a pitch of about 0.5 mm. can be achieved.

Once the contact strip is formed, it is then preferably placed in a pre-formed housing mold. A molten material, such as liquid crystal polymer, is injected into the mold and permitted to set so that the contacts are securely embedded in the housing. In preferred embodiments, the preformed housing mold may be designed to produce a housing with either a latching mechanism or mating latching mechanism (e.g., reference numerals 22 and 36 shown in FIGS. 1 and 2 respectively). In a more preferred embodiment, the housing mold forms the shape of a rectangle so that two sets of contact strips can be secured in the housing at substantially the same time by placing the first set of contacts into the housing mold on a first side (e.g., reference numeral 13 in FIG. 1) of the mold corresponding to the length of the rectangle and placing the second set of contacts in the housing mold on the second side (e.g., reference numeral 15 in FIG. 1) of the mold corresponding to the length of the rectangle. In more preferable embodiments, the housing mold is designed to form the housing and mating housings so they provide interlocking portions (e.g., reference numerals 28 and 29 shown in FIGS. 3A and 3B). The housing mold may also produce housings with a nonsymmetrical shape for purposes of identifying the polarity of the connector as described above.

After the plastic sets, the detachable carrier strip 70 is detached from the contacts. The first ends (reference numerals 16 in FIGS. 1, 2, 3A and 3B) of the contacts are then electrically interfaced with designated input and output leads of a PCB. Preferably, the first ends of the contacts are also used to mount the connector to the PCB by, for example, soldering the first ends of the contacts to the PCB leads. However, it should be understood that a separate mounting means can be provided as mentioned above. A retaining means may be used to secure the connector to the PCB while the contacts are soldered to the leads or while the connector is otherwise mounted to the PCB. For example, the connectors can be screwed or bolted to the PCB or held on the PCB by a hold-down associated with the housing. In such a case, the housing mold would preferably form an appropriate aperture in the housing for a screw or bolt to be received.

Figure 9:
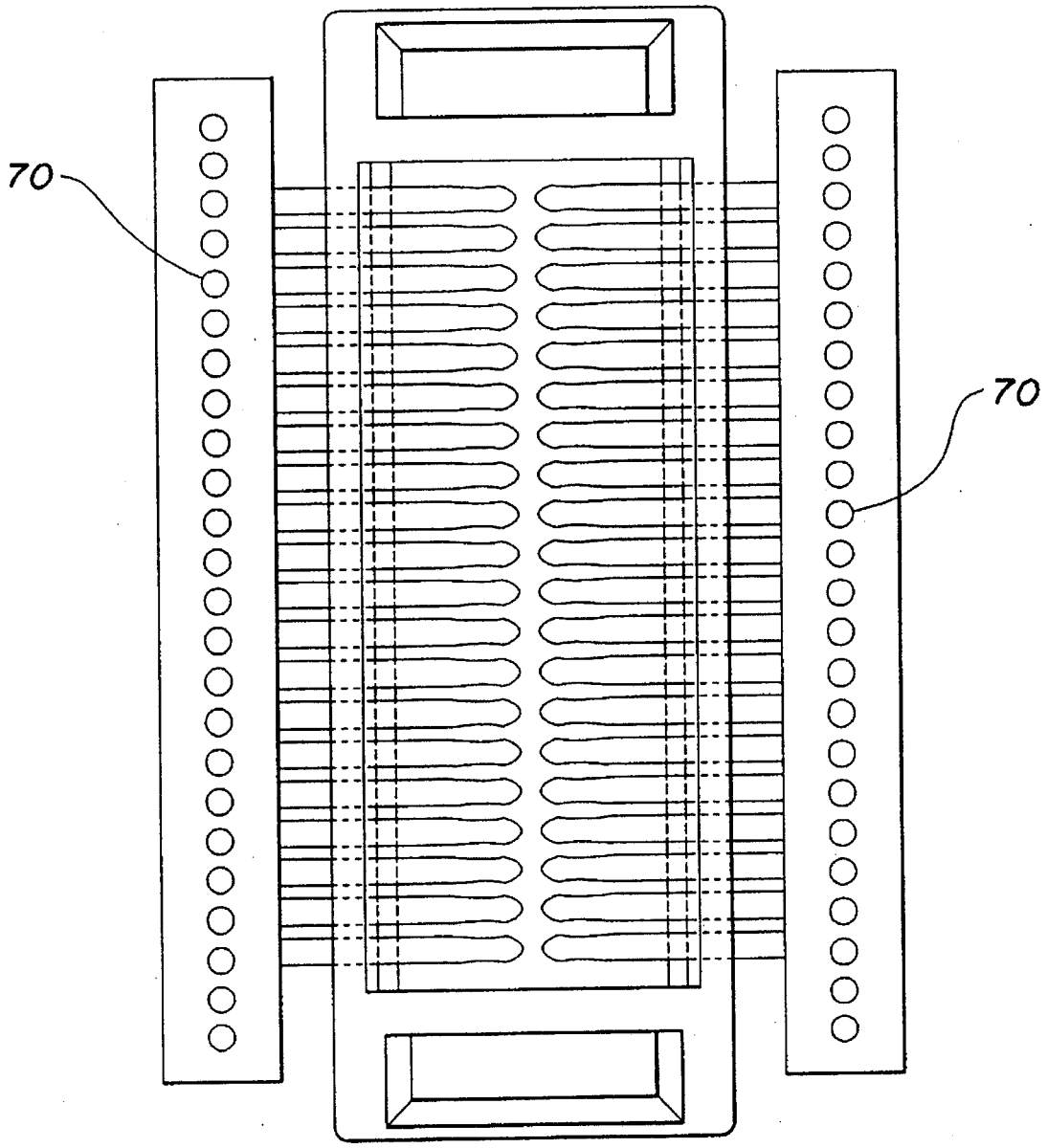
FIG. 9 shows a low profile connector substrate according to a preferred embodiment of the invention.

In a preferred embodiment in which two sets of contact strips are mounted in rectangular housing, the contacts are preferably formed so that the detachable strips are attached to the contacts on the outside of the housing. FIG. 9 shows a low profile connector with the carrier strips 70 still attached to the first ends (reference numeral 16 in FIGS. 1, 2, 3A and 3B) of the contacts (defined as a low profile connector substrate). It should be understood that low profile connector substrates can be connected to a PCB before the detachable carrier strips are detached from the contacts.

While the invention has been described and illustrated with reference to specific embodiments, those skilled in the art will recognize that modification and variations may be made without departing from the principles of the invention as described hereinabove and set forth in the following claims.

What is claimed:

1. A low profile connector system for use in electrically connecting circuit boards together in a stacked arrangement, said circuit boards having a plurality of electrical leads, the low profile connector comprising:

a first connector comprising:

a first set of electrical contacts, each electrical contact having a first end capable of being electrically interfaced with one of the electrical leads of one circuit board and a second end; and a housing having a lateral face in which said first set of electrical contacts are secured and having a mounting means for use in mounting said housing to said one circuit board with said lateral face disposed in an angular relationship with respect to said circuit board so that said first set of contacts extends from said lateral face with at least said second ends of said first set of electrical contacts being unsupported and substantially parallel to said circuit board; and a mating connector capable of mating with said first connector comprising:

a mating set of electrical contacts, each electrical contact of said mating set having a first end capable of being mated to one of the electrical leads on another circuit board and a second end for mating with one of said second ends of the first set of contacts; and a mating housing having a lateral face in which said mating set of electrical contacts are secured and having a mounting means for use in mounting said mating housing to said other circuit board so that said mating set of contacts extends from said lateral face of said mating housing with at least said second ends of said mating set of electrical contacts being unsupported an substantially parallel to said other circuit board.

2. The connector system of claim 1, further comprising:

a second set of electrical contacts, each electrical contact of said second set having a first end and a second end;

said second set of electrical contacts being secured by said housing so that said second ends of said second set of electrical contacts remain unsupported, said second ends of said first set of contacts extending from said housing towards said second ends of said second set of contacts.

3. The connector system of claim 1, wherein said first set of electrical contacts are molded into said housing.

4. The connector system of claim 1, wherein said electrical contacts are angled to extend beyond a mating reference of said connector.

5. The connector system of claim 1, wherein said electrical contacts extend from said housing to form a U-shape.

6. The connector system of claim 1, wherein said electrical contacts provide a substantially optimal compliance based on maximizing the following relationship:

$$P_{min} \times 4L^3Ebh^3 - S_{max} \times 2L^2/2Eh$$

in which:

$P_{min}$ is the minimum normal force of the electrical contacts required to provide an electrical interface;

L is the length of the electrical contacts;

b is the width of the electrical contacts;

h is the thickness of the electrical contacts;

E is the elasticity of the electrical contacts; and $S_{max}$ is the maximum stress of the electrical contacts.

7. The connector system of claim 1, wherein said electrical contacts have a compliance within a range of about 0.1 mm. to about 0.2 mm.

8. The connector system of claim 1, wherein said housing and said mating housing are capable of interlocking with each other.

9. The connector system of claim 1, wherein said housing and said mating housing provide an indication of the polarity of said electrical contacts connected thereto.

10. The connector system of claim 1, wherein the combined height of said housing and said mating housing once mated with one another is less than approximately 3.5 mm.

11. The connector system of claim 1, wherein the combined height of said housing and said mating housing once mated with one another is less than approximately 2.5 mm.

12. The connector system of claim 1, wherein the electrical contacts of said first set and said electrical contacts of said mating set are angled to extend beyond a mating reference relative to said connector to provide a substantially optimal compliance.

13. The connector system of claim 1, wherein said housing comprises a latching mechanism and said mating housing comprises a mating latching mechanism such that said latching mechanism and said mating latching mechanism are operable to latch said mating housing to said housing.

14. The connector system of claim 13, wherein said latching mechanism has an aperture and said mating latching mechanism has a barbed beam capable of being inserted through said aperture to latch said housing and said mating housing together.

15. The connector system of claim 1, further comprising:

a second set of electrical contacts, each electrical contact of said second set having a first end and a second end;

said second set of electrical contacts being secured by said housing so that said second ends of said second set of contacts remain unsupported, said second ends of said first set of contacts extending from said housing towards said second ends of said second set of contacts; and a second mating set of electrical contacts, each electrical contact of said second mating set having a first end and a second end, said second mating set of electrical contacts being secured by said mating housing so that said second ends of said second mating set of electrical contacts remain unsupported, said second ends of said first mating set of electrical contacts extending from said housing towards said second ends of said second mating set of electrical contacts.

16. The connector system of claim 1, wherein the distance between the centers of said electrical contacts does not exceed approximately 0.5 mm.

17. A process of using low profile connectors to connect circuit boards together, each low profile connector comprising a housing and at least one set of electrical contacts secured in the housing, each electrical contact having a first end for connecting to a conductor on a circuit substrate and a second end for mating with another electrical contact, the process comprising the steps of:

connecting a first low profile connector to one circuit board so that at least a portion of said electrical contacts of said low profile connector extend laterally from said respective housing so that said second ends are substantially parallel to said one circuit board;

connecting a mating low profile connector to a second circuit board so that at least a portion of said electrical contacts of said mating low profile connector extend laterally from said respective housing so that said second ends are substantially parallel to said second circuit board: and connecting said first low profile connector to said mating low profile connector in a stacked arrangement so that said second ends of said electrical contacts of respective connectors oppose one another to provide an electrical interface between said circuit boards, said electrical contacts of both respective connectors being compliant at said electrical interface.

18. The process of claim 17, wherein said first low profile connector and said mating low profile connector interlock with one another.

19. The process of claim 17, wherein said housing of said first low profile connector comprises a latching means and said housing of said mating low profile connector comprises a mating latching means, the process further comprising the step of:

latching said mating low profile connector to said first connector using said mating latching means and said latching means.

20. The process of claim 19, wherein said latching means has an aperture and said mating latching means comprises a barbed beam, said step of latching said connectors together being carried out by inserting said barbed beam into said aperture.

21. The process of claim 17, wherein the distance between the connected circuit boards is less than approximately 3.5 mm.

22. The process of claim 17, wherein the distance between the connected circuit boards is less than approximately 2.5 mm.

23. The process of claim 17, wherein said interfaced electrical contacts provide a substantially optimal compliance in accordance with maximizing the following relationship:

in which:

$P_{min}$ is the minimum normal force of the electrical contacts required to provide an electrical interface;

L is the length of the electrical contacts;

b is the width of the electrical contacts;

h is the thickness of the electrical contacts;

E is the elasticity of the electrical contacts; and $S_{max}$ is the maximum stress of the electrical contacts.

24. A low profile connector for use in electrically connecting circuit boards together, said circuit boards having a number of electrical leads, the low profile connector comprising:

a first set of electrical contacts, each electrical contact of said first set having a first end capable of being electrically interfaced with one of the electrical leads of one circuit board and a second end;

a second set of electrical contacts, each electrical contact of said second set having a first end capable of being electrically interfaced with one of the electrical leads of said one circuit board and a second end; and a housing having a first longitudinal side and a second longitudinal side in which said first and said second sets of electrical contacts are secured and having a mounting means for use in mounting said housing to said one circuit board so that said first and second sets of contacts extend from said housing with at least a portion of the contacts being substantially parallel to said circuit board with said second ends of each set of electrical contacts being unsupported, said first set of contacts extending from the first longitudinal side of said housing towards said second set of contacts which extend from the second longitudinal side of said housing such that said first set of contacts and said second set of contact do not extend beyond a center longitudinal axis located between said first and second longitudinal sides.

25. The connector of claim 24, further comprising:

a first mating set of electrical contacts, each electrical contact of said mating set having a first end capable of being mated to one of the electrical leads on another circuit board and a second end;

a second mating set of electrical contacts, each electrical contact of said second mating set having a first end capable of being mated to one of the electrical leads on said other circuit board and a second end;

a mating housing securing said first and second mating sets of electrical contacts and having a mounting means for use in mounting said mating housing to said other circuit board so that at least a portion of said electrical contacts of said first and second mating sets extend from said mating housing parallel to said other circuit board with said second ends of said first and second mating sets of electrical contacts being unsupported, said mating housing and said housing capable of mating to one another so that said electrical contacts of said first set are electrically interfaced with said electrical contacts of said first mating set and said electrical contacts of said second set are electrically interfaced with said electrical contacts of said second mating set.

26. The connector of claim 25, wherein said electrical contacts are molded into said housing.

27. The connector of claim 25, wherein said electrical contacts form a U-shape.

28. The connector of claim 25, wherein said electrical contacts provide a substantially optimal compliance based on maximizing the following relationship:

in which:

$P_{min}$ is the minimum normal force of the electrical contacts required to provide an electrical interface;

L is the length of the electrical contacts;

b is the width of the electrical contacts;

h is the thickness of the electrical contacts;

E is the elasticity of the electrical contacts; and $S_{max}$ is the maximum stress of the electrical contacts.

29. The connector of claim 25, wherein said electrical contacts have a compliance within a range of about 0.1 mm. to about 0.2 mm.

30. The connector of claim 25, wherein said housing and said mating housing are capable of interlocking with each other.

31. The connector of claim 25, wherein said housing and said mating housing provide an indication of the polarity of said electrical contacts secured thereto.

32. The connector of claim 25, wherein the combined height of said housing and said mating housing once mated with one another is less than approximately 3.5 mm.

33. The connector of claim 25, wherein the combined height of said housing and said mating housing once mated with one another is less than approximately 2.5 mm.

34. The connector of claim 25, wherein the electrical contacts of said first and second sets and said electrical contacts of said first and second mating sets are angled to extend beyond a mating reference relative to said connector to provide a substantially optimal compliance.

35. The connector of claim 25, wherein said housing comprises a latching mechanism and said mating housing comprises a mating latching mechanism such that said latching mechanism and said mating latching mechanism are operable to latch said mating housing to said housing.

36. The connector of claim 35, wherein said latching mechanism has an aperture and said mating latching mechanism has a barbed beam capable of being inserted through said aperture to latch said housing and said mating housing together.

37. The connector of claim 25, wherein the distance between the centers of said electrical contacts does not exceed approximately 0.5 mm.

38. An electrical connector system comprising:

a first connector comprising;

a housing having a longitudinal axis; the housing having a mounting surface adapted to face a substrate on which the housing is to be mounted, a first contact mounting surface disposed in an angular relationship with respect to the mounting surface;

a plurality of movable contacts extending from the first contact mounting surface, each of the contacts having a first end mounted for movement toward and away from the substrate in a plane intersecting the substrate and said longitudinal axis; and a second connector for mating with the first connector comprising:

a mating housing having a longitudinal axis; the mating housing having a mounting surface adapted to face a second substrate on which the mating housing is to be mounted, a first contact mounting surface disposed in an angular relationship with respect to the mounting surface; and a plurality of movable contacts extending from the first contact mounting surface, each of the contacts having a first end mounted for movement toward and away from the second substrate in a plane intersecting the second substrate and said longitudinal axis;

wherein the movable contacts of each of said first and second connectors form an electrical interface therebetween when said connectors are mated together.

39. The connector system as in claim 38, wherein the contacts are cantilevered from the contact mounting surface of each said connector.

40. The connector system as in claim 38, wherein the contact mounting surface is orthogonal to the mounting surface of each said connector.

41. The connector system as in claim 38, wherein the housing of said first connector and the mating housing of the second connector further comprise a second contact mounting surface facing the first contact mounting surface and a plurality of movable contact members extending from the second contact mounting surface toward the first contact mounting surface.

* * * * *